US012276281B2

(12) United States Patent
Badt et al.

(10) Patent No.: US 12,276,281 B2
(45) Date of Patent: Apr. 15, 2025

(54) MULTIPLE-PUMP DEVICE

(71) Applicant: MAHLE International GmbH, Troy (DE)

(72) Inventors: Maron Badt, Bietigheim (DE); Vojko Blazic, Volcja Draga (SI); Ales Cigoj, Rence (SI); Eugen Makarow, Ludwigsburg (DE); Alexander Spies, Marbach (DE); Benjamin Weimann, Radolfzell (DE)

(73) Assignee: Mahle International GmbH (DE)

( * ) Notice: Subject to any disclaimer, the term of this patent is extended or adjusted under 35 U.S.C. 154(b) by 183 days.

(21) Appl. No.: 17/966,097

(22) Filed: Oct. 14, 2022

(65) Prior Publication Data

US 2023/0121945 A1 Apr. 20, 2023

(30) Foreign Application Priority Data

Oct. 15, 2021 (DE) ..... 10 2021 211 693.0

(51) Int. Cl.
*F04D 13/06* (2006.01)
*F04D 1/00* (2006.01)
(Continued)

(52) U.S. Cl.
CPC ..... *F04D 13/06* (2013.01); *F04D 1/00* (2013.01); *F04D 13/025* (2013.01);
(Continued)

(58) Field of Classification Search
CPC .... F04D 13/14; F04D 13/064; F04D 13/0633; F04D 29/426; F04D 13/06; F04D 29/043;
(Continued)

(56) References Cited

U.S. PATENT DOCUMENTS 3,220,350 A * 11/1965 White ..... F04D 13/0613 417/357
4,738,584 A * 4/1988 Price ..... F04D 29/426 415/203

(Continued)

FOREIGN PATENT DOCUMENTS

DE 10045596 A1 4/2002
DE 102020105337 A1 9/2021

(Continued)

OTHER PUBLICATIONS

German Search Report dated Jun. 9, 2022 for copending German App. No. DE 10 2021 211 693.0.

*Primary Examiner* — Peter J Bertheaud
(74) *Attorney, Agent, or Firm* — Fishman Stewart PLLC

(57) ABSTRACT

A multiple-pump device for a vehicle may include a housing. The housing may include at least a first drive device for driving a first drive shaft with a first impeller, and a second drive device for driving a second drive shaft with a second impeller. The multiple-pump device may include a bearing shield penetrated by the first drive shaft and the second drive shaft. The beating shield may separate a wet region with the first impeller and the second impeller from a dry region with the first drive device and the second drive device. The multiple-pump device may include power electronics arranged in the dry region and connected with the bearing shield to transfer heat.

19 Claims, 3 Drawing Sheets

(51) Int. Cl.

| | |
|---|---|
| ***F04D 13/02*** | (2006.01) |
| ***F04D 13/14*** | (2006.01) |
| ***F04D 25/16*** | (2006.01) |
| ***F04D 29/043*** | (2006.01) |
| ***F04D 29/42*** | (2006.01) |
| ***F04D 29/58*** | (2006.01) |

(52) U.S. Cl.
CPC ..... *F04D 13/026* (2013.01); *F04D 13/0606* (2013.01); *F04D 13/0633* (2013.01); *F04D 13/064* (2013.01); *F04D 13/0646* (2013.01); *F04D 13/14* (2013.01); *F04D 25/16* (2013.01); *F04D 29/043* (2013.01); *F04D 29/426* (2013.01); *F04D 29/5806* (2013.01); *F04D 29/5813* (2013.01); *F04D 29/588* (2013.01)

(58) Field of Classification Search
CPC .. F04D 29/588; F04D 13/026; F04D 13/0646; F04D 13/12; F04D 29/5806; F04D 29/5813; F04D 1/00; F04D 13/025; F04D 13/0606; F04D 25/16
See application file for complete search history.

(56) References Cited

U.S. PATENT DOCUMENTS

| | | | | |
|---|---|---|---|---|
| 9,562,534 | B2 * | 2/2017 | Rosinski | F04D 13/14 |
| 9,587,639 | B2 | 3/2017 | Rosinski | |

FOREIGN PATENT DOCUMENTS

| | | | |
|---|---|---|---|
| EP | 2971786 | A1 | 1/2016 |
| WO | 2014143475 | A1 | 9/2014 |

* cited by examiner

MULTIPLE-PUMP DEVICE

CROSS-REFERENCE TO RELATED APPLICATIONS

This application claims priority to German Patent Application No. DE 10 2021 211 693.0, filed on Oct. 15, 2021, the contents of which is hereby incorporated by reference in its entirety.

TECHNICAL FIELD

The present invention relates to a multiple-pump device having a housing, in which at least one drive device for driving a first drive shaft with an associated first impeller and a second drive device for driving a second drive shaft with an associated second impeller are arranged. The invention additionally relates to a motor vehicle, for example an electric or hybrid vehicle, having such a multiple-pump device.

BACKGROUND

From EP 2 971 786 B1 a generic multiple-pump device having first and second drive devices arranged in a housing, two associated drive shafts and likewise two associated impellers is known. The known multiple-pump device has a spiral housing with spiral channels formed corresponding to the number of the impellers. With the help of this known multiple-pump device it is to be possible to reduce a parts variety and thus also assembly and production costs.

From U.S. Pat. No. 9,587,639 B2 a multiple-pump device having two or more electric motors which drive associated impellers is likewise known. There, merely common power electronics in the manner of a control board are provided, which can control both electric motors and in addition both outputs of both pumps independently of one another. By way of this, advantages in terms of installation space requirements and advantages in terms of the costs are to be likewise achieved.

In particular in electric or hybrid vehicles it is desirable for increasing a possible range to form components as light as possible yet efficiently. A weight-optimised design can be achieved for example in that components are combined and for example accommodated in a common housing, as a result of which the parts variety and indirectly also the weight can be reduced. In order to be able to design pumps, in particular for pumping coolant, smaller, it is necessary in turn to increase their output which is why increasingly powerful small electric motors are also employed. In order to be additionally able to operate these efficiently, power electronics are provided which are usually arranged in the region of the electric motor to be controlled by the former, but because of this are exposed to almost the same temperature load as the said electric motor or generally a drive device. Since an operating temperature of the power electronics, at which the same can be operated long-term without damage, is usually below a comparable operating temperature of the electric motor it is necessary to lower a temperature upper limit of the electric motor to a temperature upper limit of the electronic components of the power electronics, as a result of which however a continuous and peak output of the electric motor and thus of the drive device have to be reduced. Additionally or alternatively, more expensive electronic components for example printed circuit board materials for the power electronics can be employed which have a suitably high temperature limit, but render the production significantly more expensive.

SUMMARY

The present invention therefore deals with the problem of stating for a multiple-pump device of the generic type an improved or at least an alternative embodiment which overcomes in particular the disadvantages known from the prior art.

According to the invention, this problem is solved through the subject matter of the independent claim(s). Advantageous embodiments are subject of the dependent claim(s).

The present invention is based on the general idea of further developing a multiple-pump device known per se so that the same does not only manage with a reduced number of parts but also makes possible an active cooling of power electronics, as a result of which neither expensive electronic components or printed circuit board materials for the power electronics have to be installed nor a continuous and peak output of a drive device of the multiple-pump device has to be reduced. The multiple-pump device according to the invention has a housing in which at least one first drive device for driving a first drive shaft with an associated first impeller and a second drive device for driving a second drive shaft with an associated second impeller are arranged. Likewise provided can be a spiral housing with spiral channels formed according to the number of the impellers through which a fluid to be pumped by the respective impeller is forced. Generally, the spiral housing need not necessarily be part of the multiple-pump device, but can naturally also be realised by a bolted-on part (module or similar). According to the invention, a bearing shield is now provided, which is penetrated by the drive shafts and in particular mounts these and additionally separates a wet region of the multiple-pump device with the impellers from a dry region with the drive devices. Power electronics for controlling at least the drive devices are arranged in the dry region according to the invention and are heat-transferringly connected with the bearing shield, which offers the major advantage that the power electronics with for example a printed circuit board and electronic components arranged thereon can on the one hand be arranged protected in the dry region and on the other hand cooled by a fluid flowing in the wet region by way of the bearing shield arranged in between. Here, the bearing shield is preferentially made of a material with good heat-conducting properties such as for example aluminium and is thus able to transfer and thus discharge at least partly the heat developing during the operation of the power electronics and/or of the drive devices to the fluid flowing in the wet region, for example a coolant. By way of the design of the multiple-pump device according to the invention it is additionally possible to reduce a parts variety since the at least two drive devices can be controlled by merely one single power electronics. The greatest advantage however is in the direct cooling of the printed circuit board of the power electronics on the bearing shield. In addition, short distances to connectors such as generally a short cabling can be additionally achieved with the arrangement of the power electronics according to the invention.

In an advantageous further development of the solution according to the invention, the at least one drive device comprises an electric motor with a rotor and a stator, wherein at least one stator comprises at least one holding contour via which the power electronics can be secured.

Here, the stator is firmly arranged in the housing of the multiple-pump device which in turn is tightly connected to the spiral housing of the multiple-pump device via a sealing device. By securing the stator of the drive device in the housing of the multiple-pump device, the power electronics can also be simultaneously secured via the at least one holding contour firmly connected to the stator, wherein in particular a separate fastening of the same, for example a screwing-on, can be omitted. By way of this, in particular assembly costs and connected with this also production costs can be reduced.

In an advantageous further development of the invention, the stator can comprise a plastic over-moulded laminated core, wherein at least one holding contour is formed by the plastic over-moulding. This offers the great advantage that the holding contour need not be produced or mounted separately, but is manufactured together with the production of the stator.

In an advantageous further development of the multiple-pump device according to the invention, a stator preloads the power electronics against the bearing shield via its at least one holding contour. By way of this, a reliable, preferentially flat abutment of the power electronics against the bearing shield can be achieved, which on the opposite side is cooled by the coolant flowing in the spiral housing, so that the power electronics can likewise be effectively cooled. In order to be able to additionally improve a heat transfer in the process, a printed circuit board of the power electronics can be either supported flat on the bearing shield or a heat-conducting paste can be arranged between the bearing shield and the printed circuit board of the power electronics. Independently of the provision of such a heat-conducting paste however a reliable heat-transferring contact between the power electronics on the one hand and the bearing shield on the other hand and thus a reliable cooling of the power electronics can be ensured by the preload.

Practically, at least one holding contour of the stator engages through an associated opening of the printed circuit board of the power electronics in a positive-locking manner By way of such a positive-locking connection between the holding contour of the stator on the one hand and the associated opening in the printed circuit board formed complementarily thereto on the other hand a poka-yoke system can be produced which exclusively allows a single predefined installation position. The positive-locking engagement of the at least one holding contour in the associated opening additionally facilitates a mounting of the multiple-pump device according to the invention, since the power electronics before or after the cabling can be simply plugged on the associated holding contour of the stator or of the stators of the two drive devices and together with this/these be installed in the housing. Following this, a comparatively simple connecting of the housing with the spiral housing is possible.

In a further advantageous embodiment of the multiple-pump device according to the invention, at least one holding contour of the stator is bonded and/or heat-staked. By way of this it is possible to secure the previously assumed predefined and sole installation position which is enforced by the positive-locking connection between the holding contour and the printed circuit board of the power electronics, in that for example the holding contour is glued to the printed circuit board. A hot-staking also constitutes a firmly bonded connection which besides the positive-locking connection via the holding contour in the associated opening also makes possible a non-positive connection.

In an advantageous further development of the solution according to the invention, at least one positioning contour is provided on the bearing shield and at least one counter-positioning contour formed complementarily thereto is provided on the power electronics, which together form a so-called poka-yoke system. Such positioning contours and associated counter-positioning contours formed complementarily thereto make possible a comparatively simple and position-exact mounting, in which the power electronics, with respect to the bearing shield, assumes an exactly predefined installation position. Another assembly is not possible as a result of which it is possible even for unskilled workers to produce the multiple-pump device at least in this work step.

Practically, the power electronics is designed at least for controlling at least the drive devices. By way of the power electronics it is thus possible to control both drive devices, as a result of which previously separate power electronics for each drive device can be omitted or for example combined. With the multiple-pump device according to the invention and its power electronics it is even possible not only to control the two drive devices, but additionally also control even further, in particular external components such as for example actuators, fans, auxiliary units etc. A signal processing of for example sensors is also easily possible.

In a further advantageous embodiment of the multiple-pump device according to the invention, the two impellers in the wet region are fluidically connected with one another or fluidically separated from one another. By way of a fluidic separation it is possible to employ the two impellers, for example generally the at least two impellers for delivering different fluids, for example different coolants. By way of this it is possible in turn to serve two different coolant circuits with the multiple-pump device according to the invention, by way of which the previously required separate pumps can be combined or replaced with the multiple-pump device according to the invention.

Practically, the bearing shield is at least partially formed from aluminium. Aluminium has a high heat conductivity and is thus able to discharge the heat that occurs on the power electronics during the operation or also the heat generated by the associated electric motors or generally drive devices to the coolant or generally fluid flowing in the wet region of the multiple-pump device. Obviously, other metals but also heat-conductive plastics are also conceivable, wherein in particular metals have the great advantage that these can also easily receive the bearings required for mounting the drive shafts.

Practically, the housing and/or the spiral housing are/is at least partially formed from plastic. Because of this, a heat-insulating covering in the region of the spiral housing can be created on the one hand and it is possible at the same time compared with purely metallic housings to form both the spiral housing and also the housing for the drive devices comparatively easily and additionally cost-effectively.

In a further advantageous embodiment of the solution according to the invention, the bearing shield, in the region of at least one impeller, comprises a recess in which the associated impeller is at least partially arranged. Because of this, a flow-optimised arrangement of the respective impeller in the axial direction is possible, so that for example the impeller with its blades can be arranged so as to be aligned with the respective spiral outlet and rotates in the recess with a carrier shield holding the blades. Such a recess can also be formed in the region of the spiral housing, wherein an axial thickness of the respective carrier shield can substantially correspond to an axial thickness of the respective recess, by way of which a particularly flow-optimised arrangement of the respective impeller with respect to the spiral channel is made possible.

In a particularly preferred embodiment of the solution according to the invention, the bearing shield and the spiral housing delimits the wet region. Because of this it is possible to assign the bearing shield not only the function of the cooling of the power electronics and the respective drive devices but additionally also a housing function for the wet region and if required even a bearing function for the drive shafts, as a result of which the bearing shield altogether combines three functions in a single component. Because of this, the parts variety and connected with this the storage/logistics costs can likewise be reduced.

Further, the present invention is based on the general idea of equipping a motor vehicle, for example an electric/hybrid vehicle, with a multiple-pump device described in the preceding paragraphs and thereby transfer the advantages enumerated with respect to the multiple-pump device to such a motor vehicle. Concretely, these are in particular a reduction of the production and assembly costs based on the reduced parts variety and an increased possible output of the multiple-pump device based on the heat-transferring connection of the power electronics to the bearing shield and a cooling of at least the power electronics or also of the drive devices by the coolant, or generally fluid, flowing through the wet region of the multiple-pump device.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically.

DETAILED DESCRIPTION

Figure 1:
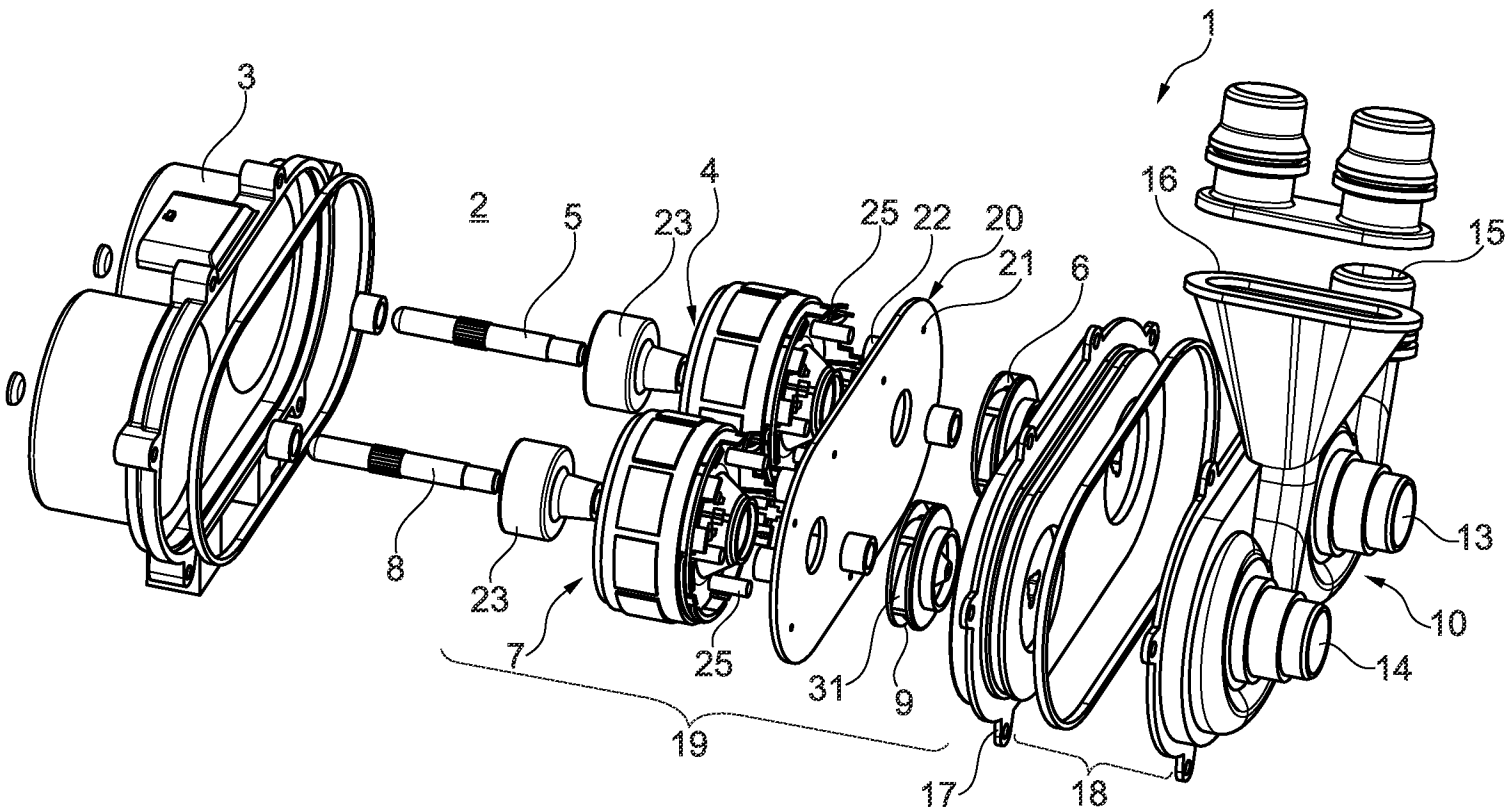
FIG. 1 is an exploded representation of the multiple-pump device according to the invention.
Figure 2:
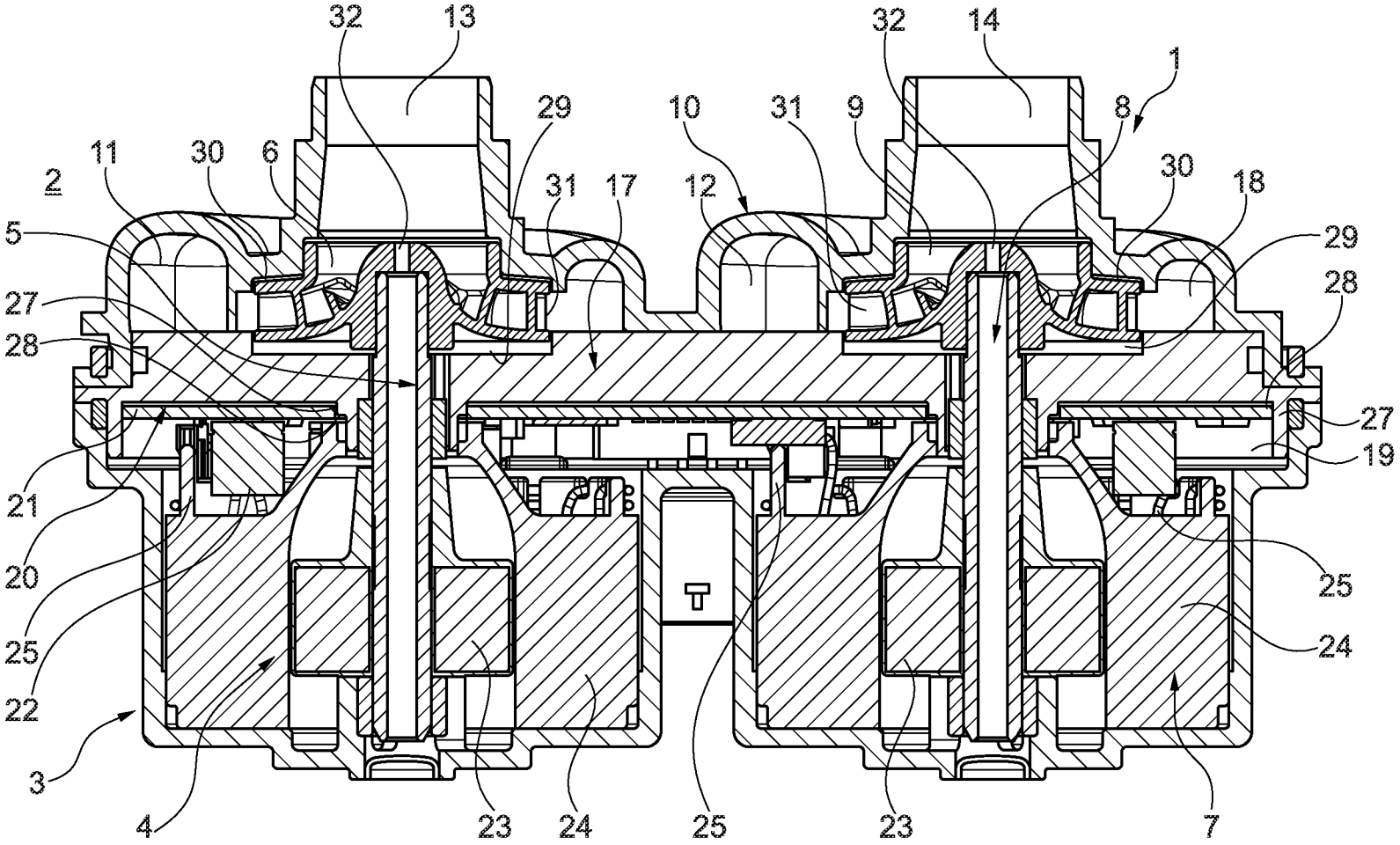
FIG. 2 is a sectional representation through the multiple-pump device according to the invention.
Figure 3:
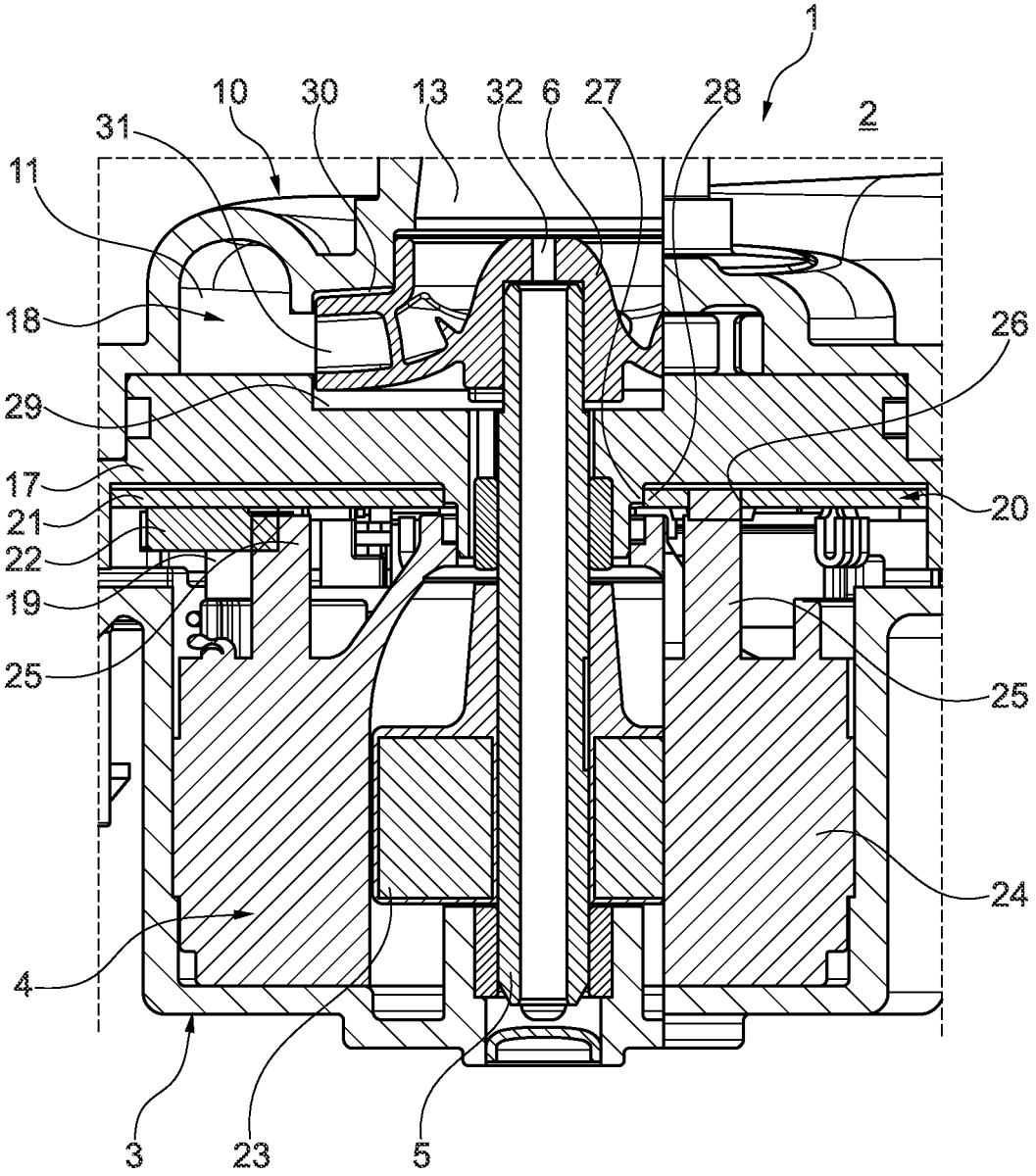
FIG. 3 is a detail representation for illustrating a connection of the power electronics to the bearing shield and at the same time its support by way of holding contours of the stator.

According to the FIGS. 1 to 3, a multiple-pump device 1 according to the invention, which can be employed for example as coolant pump in a motor vehicle 2, in particular in an electric or hybrid vehicle, comprises a housing 3 in which at least one first drive device 4 for driving a first drive shaft 5 with an associated first impeller 6 and a second drive device 7 for driving a second drive shaft 8 with an associated second impeller 9 are arranged.

In the following, only the two drive devices 4, 7 are mentioned, wherein the multiple-pump device 1 according to the invention can also comprise further drive devices with further drive shafts and impellers.

The housing 3 is connected via a seal to a spiral housing 10 with a number of spiral channels 11, 12 corresponding to the number of the impellers 6, 9. Generally, the spiral housing 10 need not necessarily be part of the multiple-pump device 1, but can obviously also be realised by a screwed-on part (module or similar). Here, suctioning of a fluid to be delivered takes place via a first inlet 13 and a second inlet 14 and a discharge of the fluid to be delivered via a first outlet 15 and a second outlet 16. According to the invention, a bearing shield 17 (see in particular also the FIGS. 2 and 3) is now provided, which is penetrated by the drive shafts 5, 8 and also mounts these and additionally separates a wet region 18 with the impellers 6, 9 from a dry region 19 with the drive devices 4, 7. Alternatively it is obviously also conceivable that a bearing for the drive shafts 5, 8 can also be part of a stator over-moulding.

For controlling at least the two drive devices 4, 7, power electronics 20 with a printed circuit board 21 and electronic components 22 arranged thereon is provided, which are arranged in the dry region 19 and at the same time are heat-transferringly connected with the bearing shield 17. By way of this it is possible to cool the power electronics 20 by way of the fluid, for example coolant, flowing in the wet region 18, by way of which it is possible to employ more cost-effective electronic components 22 since these, because of the active cooling via the fluid flowing in the wet region 18, are no longer subjected to such a high temperature load. Indirectly, a cooling of the drive devices 4, 7 via the bearing shield 7 is even possible with the arrangement according to the invention, as a result of which the efficiency of the same can also be increased.

At least one of the drive devices 4, 7 comprises an electric motor having a rotor 23 and a stator 24, wherein the stator 24 of at least one drive device 4, 7 comprises at least one holding contour 25, via which the power electronics 20 is secured or can be secured. The holding contour 25 can bring about a stiff or resilient preload. Here, at least one stator 24 via its holding contours 25 preloads the power electronics 20 against the bearing shield 17 and thereby ensures a preferentially flat, heat-transferring contact which favours a cooling of the power electronics 20. In order to be able to additionally improve a heat transfer between the bearing shield 17 and the power electronics 20 and thus a cooling of the power electronics 20, a heat-conducting paste can be additionally arranged, purely theoretically, between the power electronics 20 and the bearing shield 17.

Viewing the FIGS. 1 to 3 it is noticeable that at least one holding contour 25 of the stator 24 engages through or engages into an associated opening 26 of the printed circuit board 21, wherein the holding contour 25 in its portion engaging through the opening 25 is formed complementarily to the opening 26 and thereby makes possible a positive-locking connection. In order to be able to additionally secure this positive-locking connection, the at least one holding contour 25 of the stator 24 can be additionally glued and/or heat-staked to the printed circuit board 21. Here, the stator 24 can comprise a laminated core over-moulded with plastic, wherein at least one holding contour 25 is formed by the plastic over-moulding.

On the bearing shield 17, at least one positioning contour 27 and on the power electronics 20 at least one counter-positioning contour 28 formed complementarily thereto can be additionally provided on the bearing shield 17, which together form a poka-yoke system and merely allow a single installation position. Because of this an incorrect assembly is virtually impossible.

The power electronics 20 can be formed for controlling the at least two drive devices 4, 7 and in addition to this also for controlling further components, in particular external components, such as for example actuators, fans, auxiliary units, wherein additionally a signal processing by the power electronics 20, for example of external sensors, is possible.

With the multiple-pump device 1 according to the invention, merely one fluid can be pumped wherein it is obviously also conceivable that the two impellers 6, 9 in the wet region 18 are fluidically separated from one another, as a result of which a delivery of different fluids via the first impeller 6 and the second impeller 9 is possible. By way of the power electronics 20 an individual control of the two drive devices 4, 7 and thus an individual regulation of the pump output is additionally possible as well.

In order to make possible as optimal a cooling of the power electronics 20 as possible, the bearing shield 17 is formed from aluminium at least in regions and thus from a material with a high heat conductivity. In addition, aluminium offers the great advantage that a mounting of the drive shafts 5, 8 is comparatively easily and precisely possible via suitable bearings. The housing 3 and/or the spiral housing 10 can be at least partially formed from plastic, as a result of which a manufacture that is not only cost-effective but also weight-optimised is possible. The bearing shield 17 and the spiral housing 10 delimit the wet region 18 and thereby make possible omitting??? further components required in the past, such as for example cover, seals, etc.

Viewing the FIGS. 2 and 3 further, it is noticeable that the bearing shield 17 in the region of at least one impeller 6, 9 comprises a recess 29 in which the associated impeller 6, 9 is at least partially arranged. Such recesses 30 are also provided in the region of the spiral housing 10, as a result of which an arrangement of blades 31 of the impellers 6, 9 aligned in the real direction with respect to the associated spiral channels 11, 12 is possible.

In order to be able to additionally better cool the drive devices 4, 7, the respective impeller 6, 9 can comprise an opening 32 and the drive shafts 5, 8 can be formed hollow, as a result of which an internal rotor cooling is made possible.

By way of the fluid flowing in the wet region 18 that can be achieved for the first time an altogether higher efficiency and/or the use of cost-effective electronic components 22 on the printed circuit board 21 of the power electronics 20 can be achieved with the multiple-pump device 1 according to the invention and the active cooling of the power electronics 20.

The invention claimed is:

1. A multiple-pump device, comprising a housing, the housing including at least a first drive device for driving a first drive shaft with a first impeller and a second drive device for driving a second drive shaft with a second impeller;

a bearing shield, the bearing shield penetrated by the first drive shaft and the second drive shaft and separating a wet region with the first impeller and the second impeller, and a dry region with the first drive device and the second drive device;

power electronics arranged in the dry region and connected with the bearing shield to transfer heat;

a spiral housing;

wherein at least one drive device of the first drive device and the second drive device includes an electric motor having a rotor and a stator;

the stator includes at least one holding contour projecting axially from the stator, via which the power electronics are secured;

wherein the housing is connected to the spiral housing via a seal; and wherein the spiral housing includes a first spiral channel corresponding to the first impeller and a second spiral channel corresponding to the second impeller.

2. The multiple-pump device according to claim 1, wherein the at least one holding contour extends axially from the stator to the power electronics.

3. The multiple-pump device according to claim 1, wherein:

the stator preloads the power electronics against the bearing shield via the at least one holding contour.

4. The multiple-pump device according to claim 1, wherein:

the at least one holding contour of the stator engages through an associated opening of a printed circuit board of the power electronics in a positive-locking manner.

5. The multiple-pump device according to claim 4, wherein:

the at least one holding contour of the stator is at least one of glued and heat-staked to the printed circuit board.

6. The multiple-pump device according to claim 1, wherein:

the stator includes a laminated core over-moulded with plastic, and the at least one holding contour is formed by a plastic over-moulding of the laminated core.

7. The multiple-pump device according to claim 1, wherein:

the bearing shield includes at least one positioning contour and the power electronics includes at least one counter-positioning contour, the at least one positioning contour and the at least one counter-positioning contour formed complementarily thereto, together forming a poka-yoke system.

8. The multiple-pump device according to claim 1, wherein:

the power electronics control at least the first drive device and the second drive device.

9. The multiple-pump device according to claim 1, wherein:

the first impeller and the second impeller in the wet region are fluidically separated from one another.

10. The multiple-pump device according to claim 1, wherein:

the bearing shield is aluminium at least in regions.

11. The multiple-pump device according to claim 1, wherein:

at least one of the housing and the spiral housing are at least partially plastic.

12. The multiple-pump device according to claim 1, wherein at least one of:

the bearing shield and the spiral housing delimit the wet region; and the bearing shield in the region of at least one of the first impeller and the second impeller includes a recess, in which the associated impeller of the at least one first impeller and second impeller is at least partially arranged.

13. The multiple-pump device according to claim 1, wherein:

at least one of the first impeller and the second impeller includes an opening; and at least one of the first drive shaft and the second drive shaft is hollow and is fluidically connected with the wet region via the associated opening of the at least one first impeller and the second impeller.

14. A motor vehicle comprising a multiple-pump device, the multiple-pump device including:

a housing including at least a first drive device for driving a first drive shaft with a first impeller, and a second drive device for driving a second drive shaft with a second impeller;

a bearing shield penetrated by the first drive shaft and the second drive shaft, the bearing shield separating a wet region with the first impeller and the second impeller, from a dry region with the first drive device and the second drive devices;

power electronics arranged in the dry region and connected to the bearing shield;

a spiral housing;

wherein at least one drive device of the first drive device and the second drive device includes an electric motor having a rotor and a stator;

the stator includes at least one holding contour projecting axially from the stator, via which the power electronics are secured;

wherein the housing is connected to the spiral housing via a seal; and wherein the spiral housing includes a first spiral channel corresponding to the first impeller and a second spiral channel corresponding to the second impeller.

15. A multiple-pump device, comprising:

a housing including a first drive device and a second drive device, the first drive device for driving a first drive shaft with a first impeller, and the second drive device for driving a second drive shaft with a second impeller;

a bearing shield separating the housing into a wet region and a dry region, the wet region including the first impeller and the second impeller, and the dry region including the first drive device and the second drive device;

power electronics for controlling the first drive device and the second drive device, the power electronics arranged in the dry region and connected to the bearing shield;

a spiral housing;

wherein at least one drive device of the first drive device and the second drive device includes an electric motor having a rotor and a stator;

wherein the stator includes at least one holding contour, via which the power electronics are secured, and wherein the at least one holding contour extends from the stator to the power electronics;

wherein the housing is connected to the spiral housing via a seal; and wherein the spiral housing includes a first spiral channel corresponding to the first impeller and a second spiral channel corresponding to the second impeller.

16. The multiple-pump device of claim 15, wherein:

the spiral housing includes a first inlet and a second inlet for delivering a fluid to the wet region and a first outlet and a second outlet for discharge the fluid.

17. The multiple-pump device of claim 16, wherein:

the fluid flows in the wet region of the housing, the power electronics are connected to the bearing shield in the dry region, and the fluid cools the power electronics via the bearing shield.

18. The multiple-pump device of claim 15, wherein:

the power electronics are connected to at least one of the first drive device and the second drive device via the at least one holding contour.

19. The multiple-pump device of claim 15, wherein:

the at least one holding contour preloads the power electronics against the bearing shield, forming a flat and heat-transferring contact with the bearing shield.

* * * * *